United States Patent [19]

Franzmann

[11] Patent Number: 4,491,050

[45] Date of Patent: Jan. 1, 1985

[54] FOOT-CONTROLLED MUSICAL INSTRUMENT

[76] Inventor: Rainer Franzmann, Rehhagweg 9, D-7800 Freiburg, Fed. Rep. of Germany

[21] Appl. No.: 545,126

[22] Filed: Oct. 25, 1983

Related U.S. Application Data

[63] Continuation-in-part of Ser. No. 284,642, Jul. 20, 1981, abandoned.

[30] Foreign Application Priority Data

Aug. 16, 1980 [DE] Fed. Rep. of Germany ..... 3030999

[51] Int. Cl.[3] ..... G10H 1/00

[52] U.S. Cl. ..... 84/1.01; 84/DIG. 25; 84/1.24

[58] Field of Search ..... 84/1.01, 1.24, 19, 207, 84/443, 444, DIG. 25

[56] References Cited

U.S. PATENT DOCUMENTS

| | | | |
|---|---|---|---|
| 613,900 | 11/1898 | George | 84/207 |
| 769,853 | 9/1904 | White | 84/207 |
| 1,148,719 | 8/1915 | Sandell | 84/19 |
| 1,712,638 | 5/1929 | Stoddard | 84/19 |
| 3,126,783 | 3/1964 | Von Gunten | 84/19 |
| 3,381,565 | 5/1968 | Haile | 84/444 |
| 3,761,598 | 9/1973 | Haile | 84/444 |
| 3,922,944 | 12/1975 | Kurosaki et al. | 84/1.01 |
| 3,962,945 | 6/1976 | Creager et al. | 84/1.01 |
| 4,121,488 | 10/1978 | Akiyama | 84/1.01 |

*Primary Examiner*—Forester W. Isen

*Attorney, Agent, or Firm*—Stonebraker, Shepard & Stephens

[57] ABSTRACT

A foot-controlled musical instrument, the control portion of which includes a heel rest mounted for rotation so that, while the heel of the playing person is firmly placed on the rest, the foot may easily be turned to various angular positions within a range of about 90 degrees, to bring the anterior part of the foot into position to make contact with any desired one of several (preferably six) pedal keys which, when activated, cause production of various sounds, e.g. according to a tonal scale. The pedal keys are mounted on a spring-loaded plate which may be depressed by foot pressure, the depression thereof serving to control certain characteristics of the produced sound. The heel rest plate is also mounted for movement in one or more linear directions in addition to its rotary movement, and these linear movements control other characteristics of the produced sound. Various other details of the control assembly are disclosed, as well as details of one form of sound production device appropriate for control by the control device or portion of the instrument.

11 Claims, 14 Drawing Figures

FOOT-CONTROLLED MUSICAL INSTRUMENT

CROSS REFERENCE TO RELATED APPLICATION

This application is a continuation-in-part of my application Ser. No. 284,642, filed July 20, 1981, now abandoned.

BACKGROUND OF THE INVENTION

This invention relates to a musical instrument which is controlled or played by the player's foot. Musical instruments which are played by foot are known in various types. In pipe organs and electronic organs, there are pedal keys to be played by one or both feet, mainly for controlling the tone degrees of the bass range. Foot keys may be completed by a plurality of additional foot controlled elements in order to simplify the manual playing actions of the player. Such a bass pedal with its additional control elements is described in West German Offenlegungsschrift No. 25 26 624, published Jan. 2, 1976.

Among percussion instruments, there are also foot controlled instruments, such as the bass drum and the hi-hat. These instruments have a lever plate moved up and down by the foot. Those lever plates may be regarded as the control device or playing device of the mentioned instruments.

As a result of the heaviness and smaller capability of the leg-foot-member as compared to the arm-hand-member of a human person, foot controlled instruments are generally used in an accomplishing or completing function or relation to a manually controlled instrument. This means that the production of accompanying and more filling sounds should be under the foot control, whereas the dominant musical parts should be produced under manual control. This splitting of the parts of the performance causes the player's attention to be drawn considerably or even almost totally to the manual performance when playing. This fact demands that the foot control actions should burden the player as little as possible, concerning his attention and his physical actions, The known foot controlled instruments for the performance of musical tones in the bass range have considerable disadvantages with reference to the playing or controlling actions, which result from the design of their playing or control members. The usual geometrical structure of the foot keys for the control of different tone degrees is advantageous only for those players who play manually on a common piano keyboard. The players of other instruments, such as stringed instruments, guitars and violins, and wind instruments, for instance, think in other geometrical structures when searching the different tone degrees. For that reason, the geometrical coincidence of foot keys and manual keys has has no special advantages for such players. A very serious disadvantage of the conventional geometrical structure of the foot keys results from the fact that large movements of the leg-foot-member must be made while playing, thus enhancing the awkwardness of the leg-foot-member and diminishing the player's energy in the manual field.

An additional and complementary use of bass pedals has not become customary especially for players of stringed and wind instruments although, as one may observe very often when rhythmic music is performed, many players like to move a foot rhythmically against the floor.

It is the object of the invention to eliminate the above mentioned disadvantages and to design a foot controlled musical instrument which has such control members, such playing correlations to the manual field, and such qualities of sound that keyboard players and, in like manner, players of other instruments, especially polyphonic plucked instruments, can use it as a perfect tone instrument complementary to the manually played main instrument.

This object is achieved through the fact that one or several control boards for foot control are placed in the action range of the player's foot, and each of these control boards has a movable bearing plate for the heel of the foot, serving as a bearing or supporting device for the player's leg-foot member, and further serving as a control device when moved by the player's foot, and pedal keys are arranged in a radial or almost radial relation to the heel bearing plate in position to be touched by the anterior part of the foot (fore-foot, or toes) while the heel remains on its bearing plate, thus rendering possible the control of tone degrees and other controls in an easy and convenient manner and without fatigue to the player, since the weight of his leg-foot member remains supported entirely or mainly by the heel bearing plate.

To simplify the description of the different control or playing elements, referring to their arrangement and mode of action, the x, y, z coordinate system will be used. The x-y plane is approximately parallel to the floor, and the y axis has about the same direction as the upper thigh of the player's leg-foot member used for playing, while the x axis is approximately horizontal and perpendicular to the y axis, that is, it extends crosswise or from side to side relative to a seated player. The z axis is vertical or approximately vertical, approximately mutually perpendicular to the x and y axes. The heel bearing plate, which is movably mounted on a control board or mounting board, has its top or heel-receiving surface aligned in the x-y plane. The whole weight of the player's leg-foot member, or such part of the weight of the player's body as is transmitted via the leg, rests on and is supported by this heel bearing plate.

The instrument of this invention should usually be played from a sitting position. Then the player puts the heel of his leg-foot-member on the bearing plate. In this way the anterior part of his foot is kept ready and unimpeded for playing action.

The movability of the bearing plate has to render possible the generation of control operations, in the main. Additionally, it facilitates and improves the playing action of the foot. The movability of the bearing plate may be in a direction which is linear or curved or circular. For clarity of understanding, the various motions will be described with reference to the above mentioned x, y, z coordinate system. Other kinds of motions or combinations of movement can be used also.

The foot-hold or heel-contacting portion of the bearing device is preferably embodied as a circular platform mounted for rotation in the x-y plane. This rotary movability facilitates the turning of the foot around the vertical axis of the shank or pivot of the platform, which will be called the heel plate.

The movability of the bearing device in x, y, or z direction renders possible different control operations. Continual adjustments as well as switching operations may be performed by these movements. The pedal keys for selection of the tone degrees are mounted on the control board in a radial or almost radial relation to the pivot of the heel plate. The maximum length of the arc of a circle on which pedal keys might be arranged depends on the maximum rotation angle which the foot can do in a convenient or comfortable playing action. By reason of the limitation of the rotation angle and of the low precision of the turning action of the foot, it is necessary to keep down the number of the pedal keys in order to achieve a good survey and an ability to find and touch a desired pedal key without visual control of the foot position.

Regardless of the tone system used, all pedal keys preferably have the same shape and embodiment. If the twelve-step tempered tone system is used, the above mentioned shortness of the arc of circle makes it impossible to have a separate pedal for each tone degree. According to the invention, each pedal key is attached to several tone degrees, and these tone degrees are distinguished from each other by an additional control operation responsive to movements of the heel plate. If the tone scale is extended to several octaves, the desired octave range is controlled or selected by a different control operation or movement of the heel plate. It follows that preferably only six pedal keys are arranged on the control board. Hence all twelve tone degrees of the tempered system are divided into two sets of tones, and the desired set is selected by a switch-over operation of the heel plate.

The provision of six pedal keys provides a good arrangement, and is preferred. With six keys, a non-visual finding of a desired key (that is, a finding only by the sense of touch or sense of motion of the foot) is easily possible because of the fact that, among the constellation or assembly of all the pedal keys, the position of a desired key can easily be remembered and imagined by the player. The distance separating one pedal key from another is well adapted to the given precision of motion of the human leg-foot-member, and is also appropriate and satisfactory when fast tone lines are to be played.

Although six pedal keys are preferred, it is possible to divide the twelve tone degrees into three sets of four tones each, using only four pedal keys instead of six. But there is a disadvantage to this, in that three control positions of the heel plate are required to select the desired tone set, instead of only two control positions as when six keys are used.

The striking of the pedal keys with the anterior part of the foot serves for the selection of tone degrees and further serves for the control of a dynamic tone attack (piano forte), that is, a variable loudness or volume of the played tone. For this last mentioned control, it is possible to equip each pedal key with its own action converted, as is usually done. However, according to one aspect of the present invention, all six pedal keys may be mounted on a key plate which is movably mounted on the control board for movement in the x-axis direction. Then only one action converter need be provided for control of a dynamic tone attack, this action converter being responsive to movement of the key plate in the x direction. All additional control members which will be used when playing are mounted on the control board.

The instrument according to the preferred embodiment of the invention consists mainly of two parts, considered from the standpoint of its architecture or construction and its function. One part is the control device, that is, the arrangement of all elements and members with which the player controls or plays the instrument. The other part is the device for sound generation, that is, the arrangement of all elements and members which generate and alter or form the sound. These two main parts may be placed in a single housing, or in two separate housings.

According to the invention, the control part might be played with one foot or with two feet. If two, each foot has its own bearing device (heel rest plate) and its own set of pedal keys. Thus there are two bearing devices and two sets of pedal keys if the player is to use two feet. This double equipment may be mounted on a single control board, or on two separate control boards. The control device or part may have its technical embodiment as a purely mechanical device, or preferably as an electro-mechanical device.

The sound generation device or part of the instrument can use purely mechanical means for generating the sound, or electromechanical means, or purely electronic means. The nature of the manually controlled main instrument will determine the actual construction or equipment of the accompanying foot-controlled instrument of the present invention. For example, if the main instrument has electronic sound generation, it will be satisfactory for sound harmony that the foot-controlled instrument also has electronic sound generation. The present state of technology in the art of electronic sound generation provides many technical solutions which satisfy every demand.

When the foot-controlled instrument of the present invention is used to accompany a stringed instrument, for example an electric guitar, an electromechanical sound generating means will preferably be used. Such means will include, for example, open oscillating strings each having a fixed pitch, the strings being stimulated for oscillation and muted through electro-mechanical means of known form. The vibration of the strings is converted into electric oscillations by pick-ups, and conveyed via conventional equipment for sound altering and sound amplification to the loud speakers, the sounds from which are heard by the listeners or auditors.

The advantages of the present invention include the fact that the arrangement and mode of action of the control means allow a favorable performance of tone lines and other sound phenomena, in consideration of the capability of the leg-foot-member of the player. Tiresome movements are avoided, the control motions are short, and the arrangement of the pedal-keys provides a good survey and orientation, finally causing the manual playing of the main instrument to be carried out in an unimpeded manner.

DESCRIPTION OF THE PREFERRED EMBODIMENT

A preferred embodiment of the invention is a foot-controlled musical instrument preferably used for accompanying stringed instruments, especially electric guitars. For a better harmony in sound, the sound generation will therefore be done with strings. All mechanical control operations done by the player are converted into electrical control signals, and the equipment for sound generation is controlled electronically. The generation of sound is done in an electro-mechanical mixed mode. In the preferred form, the foot-controlled instrument is played with only one foot, thus rendering possible a normal sitting posture for the manual playing of the main instrument, e.g., the electric guitar.

In order to permit an independent placement of the speakers and the foot-operated control device, the control device and the equipment for sound generation (including the speakers) are mounted in two separate housings connected by a conductor cable of any desired length. Because of the fact that the strings are mounted in a housing separate from the control device, it is possible to dimension the housing of the control device in a very compact size, favorable for a problem-free and convenient placement within the action range of the player. The player is able to use any desired seating. His second leg, not used for operating the control device, may be placed in any usual or convenient posture. The control device is of very low height above the supporting floor, thus making possible a comfortable action of the playing leg-foot-member while the player sits on a common or ordinary seating unit, no special seating being required.

Figure 1:
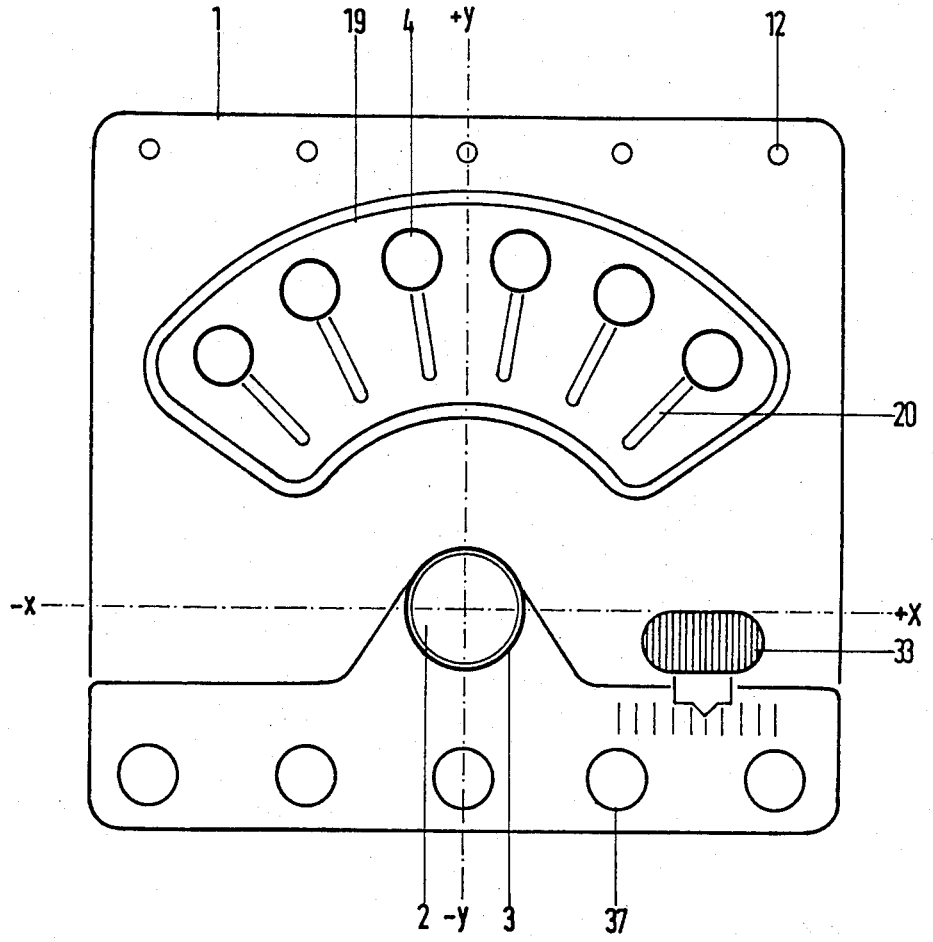
FIG. 1 is a plan view of a control device according to the present invention, designed for playing with one foot.
Figure 2:
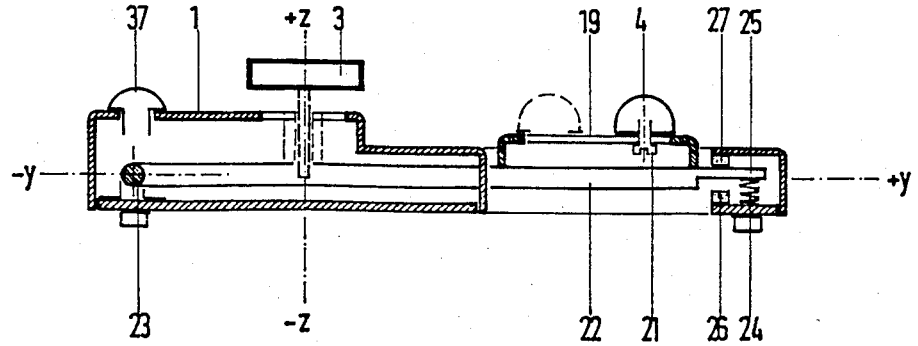
FIG. 2 is a schematic vertical section through the same, taken in the direction of the y axis.

Referring now to the drawings and especially to FIGS. 1 and 2, the control device has a housing 1 of generally flat rectangular shape. This housing together with its several control or playing elements may be referred to in general as the control board.

On the control housing is a foot bearing device or foot hold 2 in the form of a circular plate 3 of sturdy material, on which the heel of the player rests, and which may be called the heel plate. This bearing device or heel plate lies in or approximately in the x-y plane (i.e., approximately parallel to the floor) and is mounted for limited movement in the z direction perpendicular to the x-y plane, that is, movement upwardly and downwardly, by means of suitable bearings and guide elements. All parts of the construction loaded by the leg-foot-member are sturdily constructed and so dimensioned that proper functioning of the bearing device is assured even under maximum load. The heel plate 3 is held above the housing 1 so that movability in all directions is possible. In order to achieve a fast and unimpeded playing technique, the lengths of the control movements are dimensioned as short as possible.

When the heel of the playing foot is supported by the heel plate 3, the anterior part of the foot is in position to touch and activate any desired one of the various pedal keys 4 for the control of tone degree. The heel plate is rotatable so that the foot may easily turn to overlie the desired pedal key. In the construction shown in FIG. 1, the distance from the heel plate to the pedal keys is adjustable by moving the pedal keys 4 along the slots 20 arranged radially with respect to the heel plate, in order to adapt to various sizes of foot. But instead of making them adjustable, the pedal keys may be elongated in a radial direction, as shown at 83 in FIG. 13.

The pedal keys 4 or 83 are arranged on an arc of a circle concentric with the heel support plate 3, and are equally spaced from each other in a circumferential direction. The maximum rotation angle of the foot which can be played comfortably is about a right angle or 90 degrees. This is not an absolute or invariable maximum, as some players may be able to turn the foot without difficulty through a greater angle, and some less. In the preferred construction, the keys 4 or 83 are spaced through an arc of 90 degrees. In order to guarantee a comfortable finding of a particular desired pedal key without visual help, and in view of the limited precision of the leg-foot-member when playing, it is necessary to make the distance between adjacent keys not too small, and the number of keys not too large. In the preferred construction, there are six keys 4 or 83, with a rotation angle of 18 degrees between adjacent keys, so that the total rotation angle from the first key to the last is 90 degrees.

The pedal keys 4 or 83 serve for the selection of the various tone degrees, here organized in the tempered system. The mechanical-electrical converters which are attached to each pedal key have, loaded or unloaded, only two switching positions, that is a control value of one bit. Sensors (converters) responsive to pressure or load may be used. They are known in various types.

If two or more pedal keys (4 or 83) are touched or loaded at the same time, the signals from these keys will be computed in an electronic equipment in such a way that only one signal passes on, preferably that one which is nearer to the inner edge of the foot. The other signals are cancelled then. Such circuits arrangements are well known. The use of such a circuit compensates for the limited precision of movement of the leg-foot-member.

The pedal keys 4 may have approximately the shape of a hemisphere, which is a favorable shape for a precise fixing of the point of contact or touch by the foot of the player. Similarly, the pedal keys 83 of the elongated form may be semicircular in cross section, except at their rounded ends. The keys are made of a sturdy and polished material, e.g., polished refined steel. The polished surface facilitates a rapid sliding change of touch from one key to another.

Figure 3:
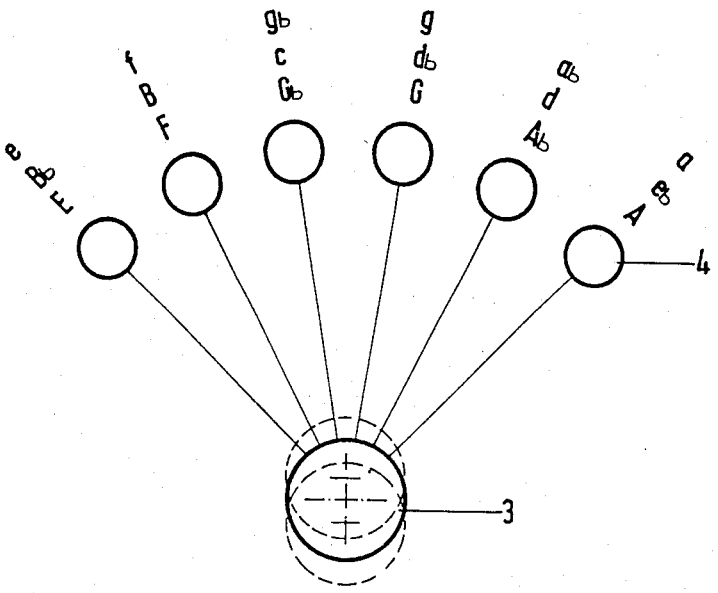
FIG. 3 is a schematic view illustrating the arrangement of the tone degrees with reference to the pedal keys.

Each of the pedal keys controls several tone degrees. The particular tone degree to be played when a particular pedal key is activated is selected through the control operated by the bearing device or heel plate. FIG. 3 shows an arrangement for tone-degree control through movement of the heel plate in the y-direction, that is, by movement of the heel plate approximately horizontally toward or away from the player. The interval of the tone degrees from one pedal key to the next is a semitone. Preferably the pitch rises from left to right. The six pedal keys represent actually one-half of all twelve tone degrees, or what is herein called a semi-scale.

Figure 4:
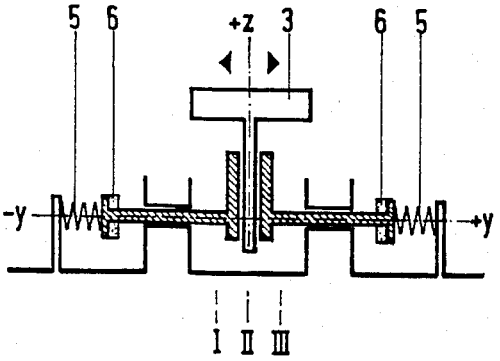
FIG. 4 is a schematic vertical section through the bearing device or heel rest, illustrating its movability in the y direction.

FIG. 4 shows schematically certain features of the construction. Here, the heel plate 3 is supported for motion in the y-direction, and can take three switching positions designated by the Roman numerals I, II, and III. The switching position I governs the semiscale E through A, the switching position II governs the semiscale B flat through e flat, and the switching position III governs the semiscale e through a. The plate is normally held in its middle switching position II by the self-acting springs 5, but may be moved to position I or position III by an active pushing of the heel plate by the player's heel.

These movements are limited by stop members, as schematically illustrated. To avoid undesired noise the stop members are coated with soft buffering substances 6. The switching positions I, II, and III can be easily distinguished from each other and found by the feel of the player's leg-foot-member without visual aid because, as above stated, springs 5 tend to hold the parts in the central II position and the mechanical stops will be engaged to prevent further movement when the I or III positions are reached. The I and III positions represent two semiscales with the same tone degrees but one octave apart. This fact simplifies memorizing the various locations of the heel plate for various tone degrees to be played.

Figure 5:
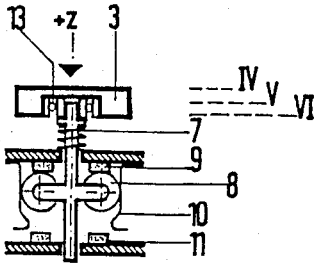
FIG. 5 is a similar view illustrating the movability of the bearing device in the z direction.

In order to enlarge the tone range of the instrument to a range of about two and a half octaves, according to the tone range of a contrabass, an electronic circuit for octave dividing is used. FIG. 5 illustrates the mounting of the heel plate 3 for movement in the up and down or z-direction, in addition to the movement in the y-direction. Preferably this z-direction movement also represents three switching positions, here designated by the Roman numerals IV, V, and VI. Position IV is the top position, maintained by the spring 7 when there is no loading or downward pressure on the heel plate 3. In this position the rollers 8, mounted on the shank of the heel plate, are pressed upwardly against the limiting stop buffers 9.

When the heel plate is loaded by moderate downward pressure from the heel of the player, it moves downwardly in the z-direction until the rollers 8 engage the spring clamps or detents 10, which provide enough resistance to further downward movement so that this position can be felt and recognized by the leg-foot member of the player. This constitutes the V position. The force or strength of the spring 7 and the spring clips 10 is such that they will hold the parts in this intermediate position V under the whole weight of the leg-foot-member when it rests in relaxed fashion on the heel plate. When the player consciously raises his heel, the spring 7 will move the plate up to the top or IV position. When the player puts additional downward pressure on his heel, over and above the normal relaxed weight of his leg-foot-member, the force of the spring clips 10 will be overcome and the heel plate will move down to position VI, the bottom position, in which the rollers 8 engage the limiting buffers 11.

The use of these rollers 8 and spring clips or clamps 10 is only one possibility. Click stop devices of conventional known form may be used to define the three positions of the heel plate in the z-direction, provided they work sufficiently noiselessly.

Switching position V does not switch anything. Switching positions IV and VI switch the three semiscales alternately down or up, transposing about one octave. The switched octave range is preferably indicated optically by the lit or unlit condition of one or more light emitting diodes 12 (FIG. 1) mounted on the control board.

Figure 14:
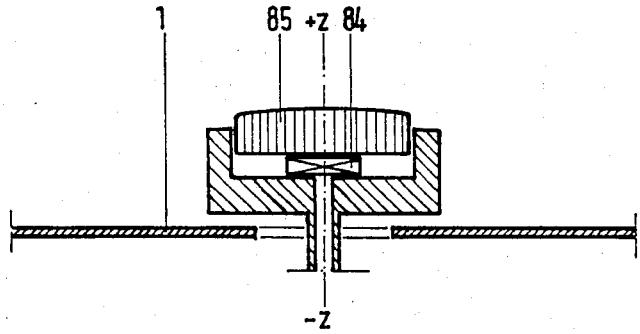
FIG. 14 is a vertical section through the heel rest illustrating schematically the control or converting means responsive to varying pressure of the heel.

Another possibility for controlling the octave ranges of the instrument is shown schematically in FIG. 14. Here, instead of mounting the heel plate for upward and downward motion, it is provided with a pressure-sensitive electronic converter 84 mounted beneath a cover member 85 which may be a flexible membrane or a rigid plate resting on the sensor 84. Just as in the case of the embodiment shown in FIG. 5, three switching positions are defined in this pressure-sensitive embodiment.

First, the heel plate is unloaded, that is, no appreciable weight upon it. This corresponds to position IV previously mentioned. Second, the heel plate is loaded merely with the relaxed weight of the leg-foot-member. In this position, the upper octave range will be switched on. Third, the heel plate is actively loaded with more pressure. The change in voltage or current under the control of the pressure sensitive sensor 84 switches the lower octave range on, and the upper range off, of course. This mode of switching avoids a motion in the z-direction because it uses merely the magnitude of pressure of the heel as the control factor, rather than an actual substantial physical movement. In the first switching position, corresponding to switching position IV, all played sounds may be directly stopped or switched out; or, alternatively, all functions of the instrument may be switched out; or again alternatively, a special envelope curve of the sound may be switched on.

The semiscale E–A occurs in both octave ranges. This is advantageous when the played tones often move from one octave range to the other. In other words, the two octave ranges overlap each other in the range of this semiscale. It follows that all thirty-two tone degrees used in this examplary embodiment can be played precisely by means of the six pedal keys 4 or 83 in combination with the various switching positions of the heel plate 3, whereby the movements of the playing foot are as small as possible. This renders possible a very comfortable and fluent playing technique.

For maximum ease and smoothness of rotation of the foot in order to activate the desired one of the pedal keys, it is desirable that the heel plate be rotatable. This feature is illustrated in FIG. 5, which shows the heel plate 3 rotationally supported on its shank by a bearing 13, preferably a ball bearing, so that the heel plate may rotate freely in the x-y plane. This rotatability of the plate improves the certainty of routine of the player's control motions.

Figure 6:
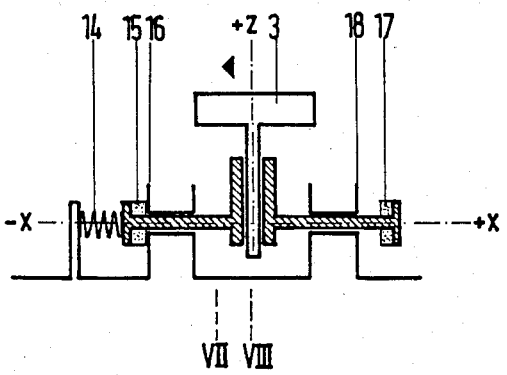
FIG. 6 is a similar view to illustrate movability in the x direction.

Still another motion of the heel plate is possible, to perform additional switching functions, and this is illustrated in FIG. 6. Here it is seen that the heel plate 3 is mounted for horizontal movement along the x-axis between positions designated VII and VIII. The spring 14 tends to move the slide or carrier on which the heel plate is mounted in the +x direction until the soft sound-deadening buffer 15 on the slide comes into contact with the fixed stop 16. This determines the VIII position. When heel pressure is exerted in the −x direction, the heel plate and its slide move in the −x direction against the force of the spring, until another buffer 17 on the slide comes into contact with the fixed stop 18. This is the VII position.

The VIII position is the normal or standard position. Movement of the heel plate slide to the VII position switches on a device which prevents the muting of the sounding tones even though the player takes his foot off the concerned pedal keys 4 or 83. The function of this device is similar to that of the pedal of a piano, which lifts the dampers. By this, a simultaneous sound of successively played tones is rendered possible. The two switching positions VII and VIII are found easily by feel, without any visual aid.

FIGS. 4, 5, and 6 and the related description have disclosed in principle the desired motions of the heel plate and the switching functions or other functions to be performed by those motions. With this information at hand, it will be possible for any skilled worker to build a suitable physical or technical embodiment, taking advantage of the many forms of bearings, guides, slides, switches, etc., which are well know and readily available.

Figure 13:
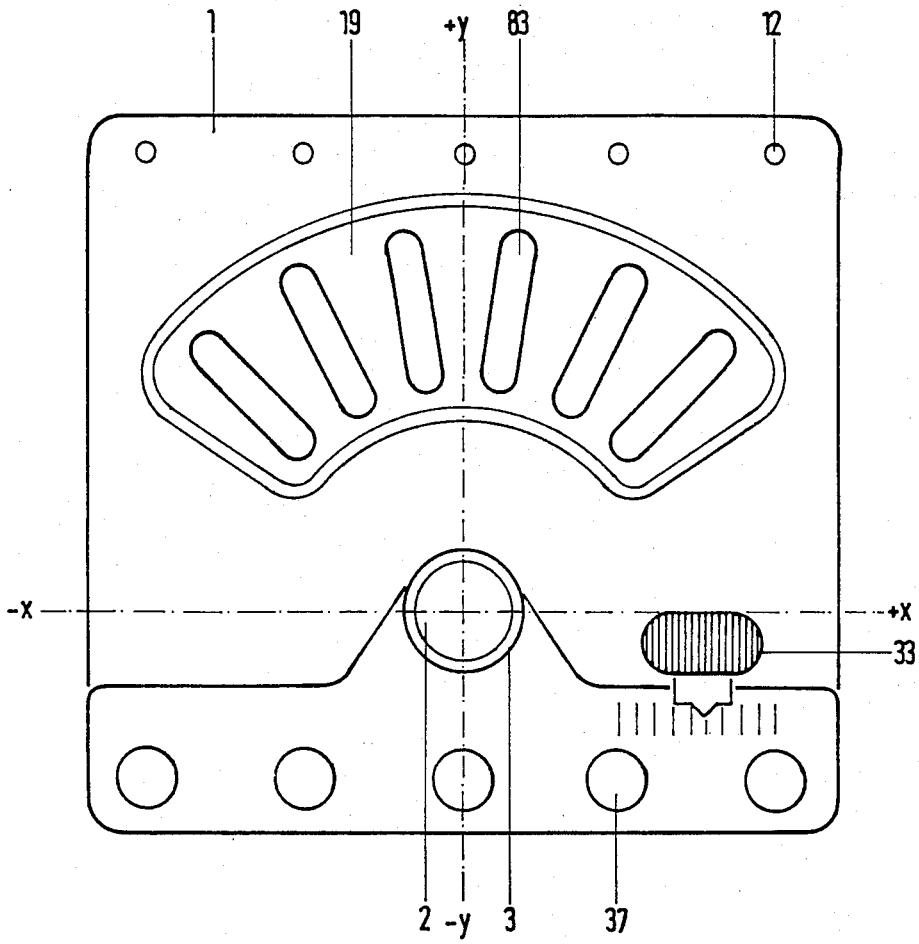
FIG. 13 is a view similar to FIG. 1 showing a modified shape of the pedal keys.

FIGS. 1, 2, and 13 show the pedal keys (4 or 83) mounted on a key plate 19. If the pedal keys are adjustable toward and away from the heel plate, along the radial slots 20 (FIG. 1) they are held in adjusted position by set screws 21 (FIG. 2) from the lower side of the key plate. In either case, whether the keys are adjustable as in FIGS. 1 and 2 or whether they are elongated and therefore not adjustable as in FIG. 13, the key plate 19 is preferably mounted for upward and downward movement in the z-direction. This is preferably accomplished by mounting the key plate on a pair of spaced parallel arms 22 (FIG. 2) rigidly connected to each other by a shaft 23 which turns in bearings in the housing 1. If the pedal keys 4 or 83 are loaded by substantial downward pressure of the foot, the key plate 19 will be moved down against the force of a spring 24 until a flange 25 on one or both of the arms touches the sound-deadening buffer stop 26. When the downward foot pressure is released, the spring 24 lifts the flange up against the upper buffer stop 27.

Figure 7:
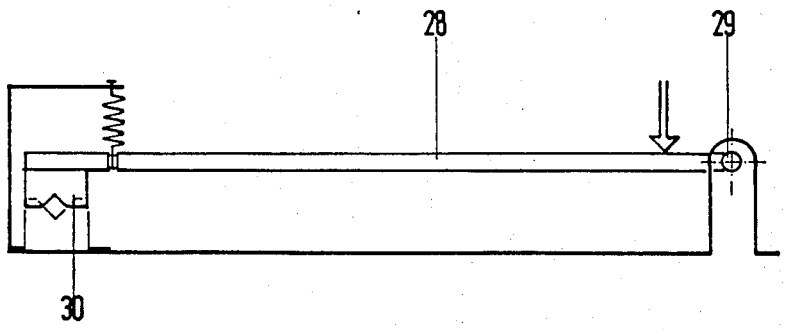
FIG. 7 is a schematic view showing mechanical members for controlling light radiation.

This movability of the key plate is used for the control of a dynamic tone-attack. A lever 28 (FIG. 7) pivoted at 29 is loaded close to its pivot, as shown schematically by the arrow, when the key plate 19 is moved. The movement of the free end of the lever 28 controls the aperture or size of the light passage through a diaphragm 30. A source of light 31 (FIG. 9) projects a beam through the diaphragm 30 to a light sensitive converter 32 (e.g., a photoelectric cell or a photoresistor) the output of which goes to the main signal processing unit 49. Thus the amount of downward pressure on the key plate controls the size of the aperture in the diaphragm, which in turn controls the amount of light received by the element 32, and this in turn controls the signal sent by the element 32 to the processing unit to control the dynamic tone-attack of the instrument.

This arrangement is only one possible embodiment. Instead of this, the downward pressure applied to the key plate may act on a pressure-sensitive converter whose output goes to the processing unit. Suitable pressure sensitive converters are known in the art. It is noted that in either arrangement, only one converter need be employed for all six pedal keys 4 or 83, which is very advantageous with regard to both technical reliability, ease of construction, and cost.

Figure 8:
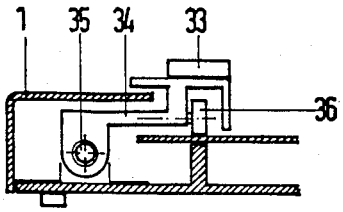
FIG. 8 is a schematic vertical section through the device, taken in the y direction.

On the top of the housing 1 is a button 33 (FIGS. 1, 8, 9, and 13) movable in the x-direction and having a pointer travelling along a graduated scale. This is the master volume control member for the entire instrument. To support it in such manner that it can be moved easily and quickly by appropriate motion of the foot even if a considerable weight of a leg is resting on it, the button is mounted on a slide 34 (FIG. 8) provided with rollers 36 and travelling along a guide rail 35. Movements of the button 33 and slide 34 cause corresponding movements of the control element of a variable rheostat 47 (FIG. 9) which, as above indicated, constitutes or operates the master volume control.

On the top of the housing 1 is a row of additional buttons 37 (FIGS. 1, 2, 9, and 13) which serve as simple on/off switches for various timbres of sound or other sound embellishments or special effects. The construction of these buttons is similar to that of the pedal keys 4.

Figure 9:
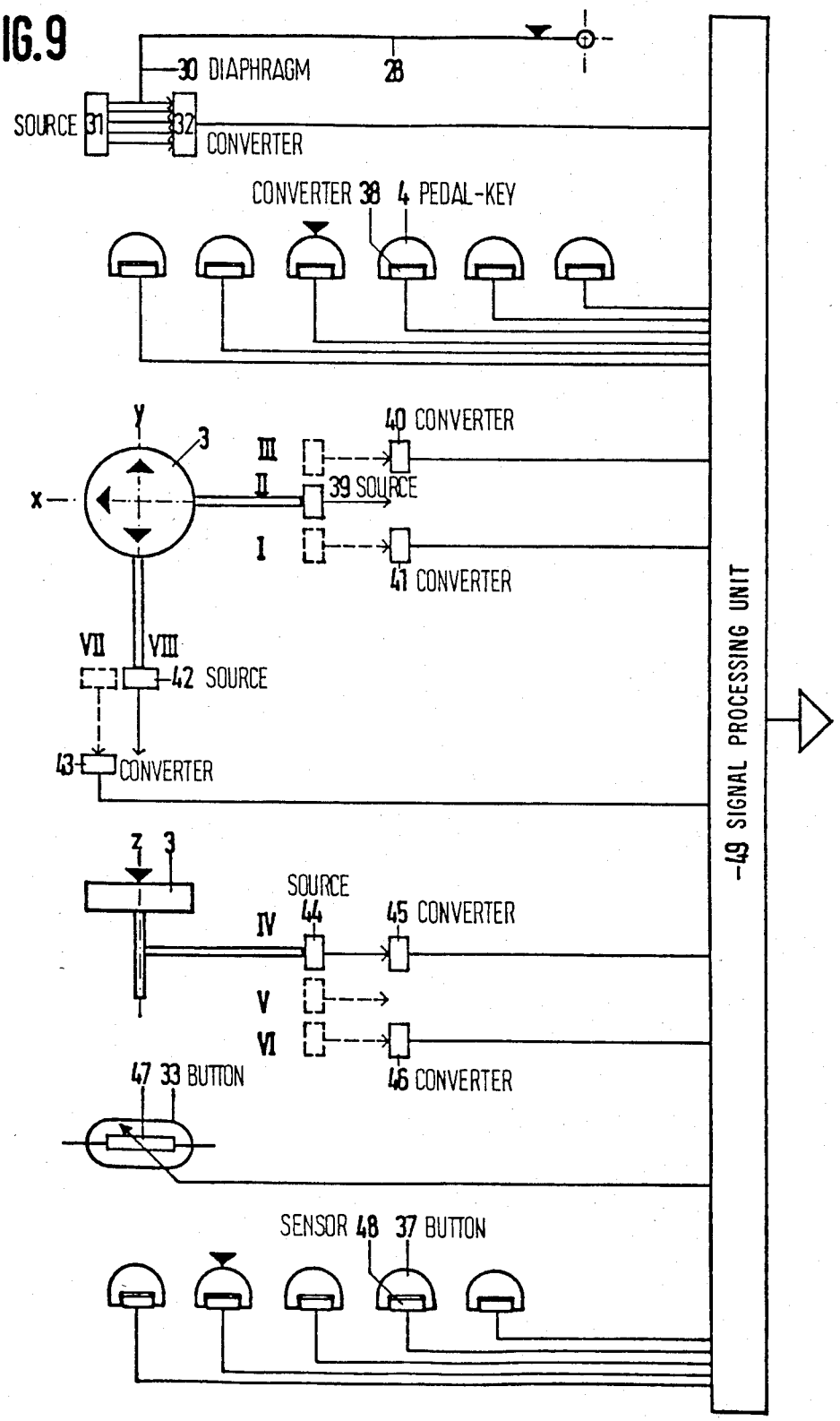
FIG. 9 is a schematic diagram of the principal mechanical and electronic control elements.

A schematic general plan of the principal mechanical and electrical control elements of the control device or portion of the instrument is shown in FIG. 9. Most of the individual parts and their operation or function have been sufficiently described above, and only a little more need be said here.

At the top of FIG. 9 the parts for control of dynamic tone-attack are shown, including the diaphragm 30 controlling the amount of light which reaches the photosensitive element 32 from the light source 31. Next below these, the pedal keys 4 (or 83) are shown, each with its own pressure-sensitive converter 38. Next beneath the pedal keys, the heel plate 3 is indicated, with a showing of its capability of movement in the y-direction to positions I, II, and III, and movement in the x-direction to positions VII and VIII. Schematically indicated is the fact that the heel plate moves a source of light 39 which, in position III, is directed onto the photosensitive converter 40, in position I is directed onto the converter 41, and in the intermediate position II is not directed to either converter. This part of the illustration also shows that when the heel plate is moved in the x-direction, it moves a source of light 42 which is directed into the photosensitive converter 43 in position VII, but not directed onto it in position VIII. Below this, the heel plate 3 is again indicated, this time to illustrate its movement in the z-direction to positions IV, V, and VI, serving to shift the light source 44 to activate respectively the photosensitive converter 45, or no converter, or converter 46.

Continuing downward in schematic FIG. 9, beneath the heel plate 3 there are shown the volume control button 33 and rheostat 47, and below them, the special switch buttons 37, each having its own pressure-sensitive converter 48. The outputs from all of the various converters or control elements go to the signal processing unit 49. In this unit, all the control signals are changed or converted into a form in which they can be transmitted to and utilized in the sound generating section or portion of the instrument. For example, all control signals may be coded in a digital code and all control elements have a digital address.

The converting members or elements mentioned above are only one possible example. Other types of converters, known in the art, may be used so long as they perform the ultimate functions above indicated.

Figure 10:
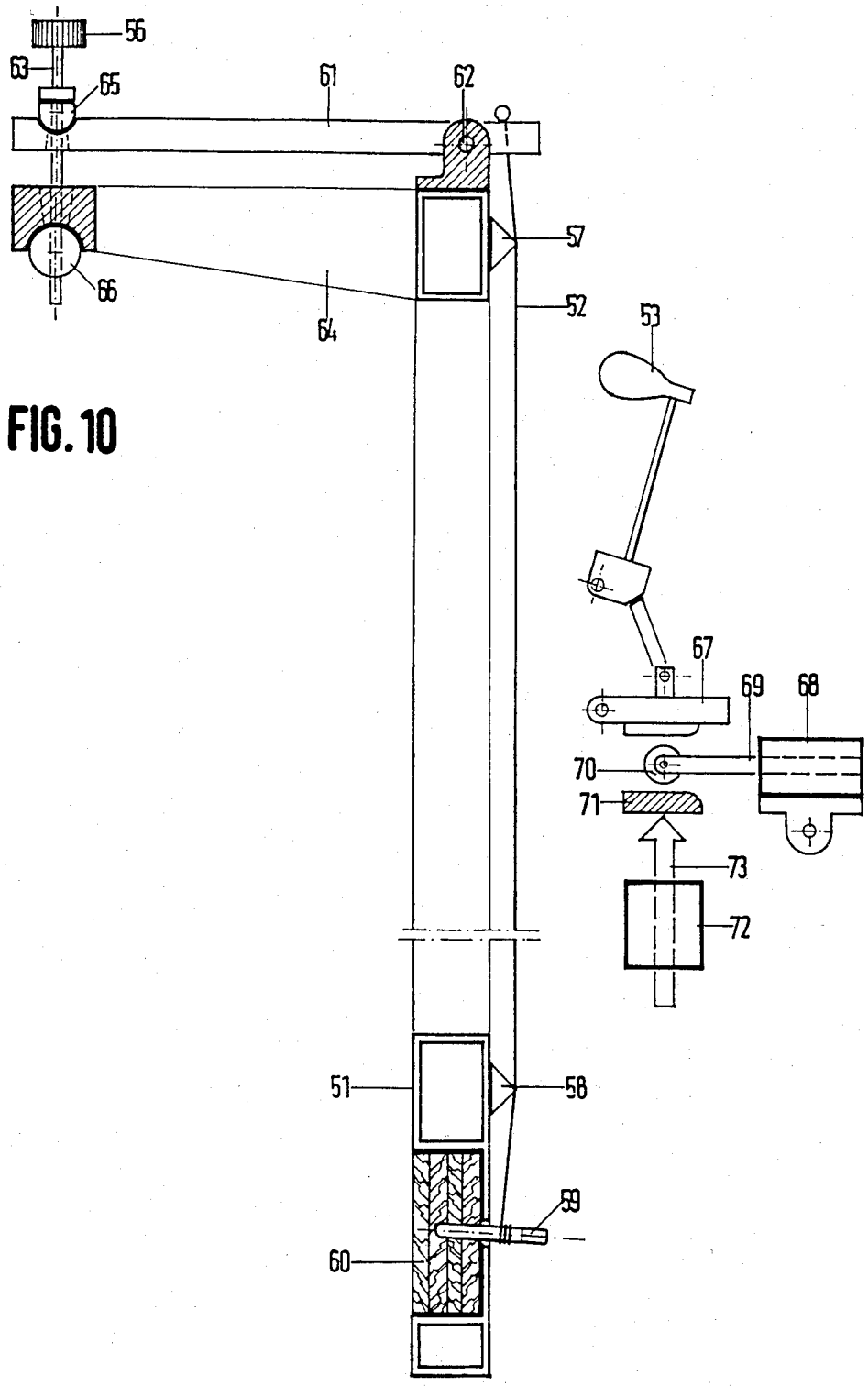
FIG. 10 is a schematic vertical section through sound generating equipment featuring strings.
Figure 11:
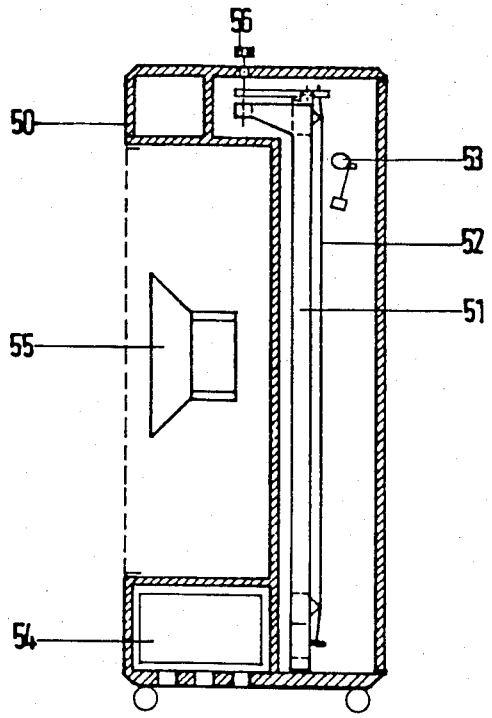
FIG. 11 is a schematic vertical section through a sound generating unit which includes the string mechanism of FIG. 10.

Turning now to the sound generating part or section of the musical instrument, an exemplary embodiment of this unit is shown schematically in FIGS. 10 and 11. In a housing 50 there is a frame 51 on which a set of strings 52 is stretched. Mechanism for stimulation and damping oscillation of the strings is indicated schematically by the hammers 53. Electronic equipment for forming, altering, and amplifying sound is housed within the compartment or chamber 54. The sounds are sent out through one or more loud speakers 55.

The string frame 51 is preferably made of metal, and is arranged in an upright position because of the length of the strings and a desire to keep the floor space area of the housing or cabinet as small as possible. Each string has a fine tuning knob 56 projecting above the top of the cabinet so as to be manually accessible, this knob being operatively connected to the upper end of its string. The string is stretched over bridges 57 and 58 to the coarse tuning peg 59 at the bottom.

These coarse or raw tuning pegs 59 are rotatable in a block of wood 60, in the usual manner of piano tuning pegs. The fine tuning knobs 56 may be connected to the strings in any suitable manner. For example, the string is connected to the short end of a lever 61 pivoted on the frame 51 at 62. The long end of the lever is acted upon by the threaded shank 63 of the knob 56. This shank extends through an opening in an arm or bracket 64 of the frame 51. A fixed collar on the shank 63 engages a bearing block 65 which presses downwardly on the long arm of the lever 61, and screw threads on the shank engage the bearing block 66 which presses upwardly on the arm 64. To avoid quoining the bearing blocks are curved as shown in FIG. 10, so that they may turn slightly relative to the respectively engaged parts 61 and 64, to accommodate the changing angle between the lever 61 and the tuning screw shank 63 as the screw is tightened or loosened.

With this arrangement, the player can conveniently and easily tune the instrument at any time. This is important for satisfactory transportability of the instrument.

Sound generation with strings has been chosen as an example, as it provides a good harmony of sound with a manually played stringed instrument, especially with an electric guitar. But if the foot-controlled instrument of the present invention is to be used to accompany a main instrument of a different type, then it is within the contemplation of the present invention to use sound generation of any other type appropriately harmonizing (or perhaps contrasting, if desired) with the sounds produced by the main instrument which is being accompanied. In most cases (but not necessarily in all cases) it will be the same player who plays the main instrument and simultaneously plays the foot controlled instrument.

When strings are used, the strings preferably have the same construction as piano strings. It has already been mentioned that the quantity or number of strings is preferably limited to the tonal range from E to a. This range has been arbitrarily chosen as a satisfactory one, as it is a good adaptation to the stock of tone degrees given by an electric guitar. But without departing from the invention, any different tonal range may be chosen. The preferred use of strings only for the upper octave range of E–a results in a convenient limitation of weight and size, and also is in accord with the requirement for comfortable and convenient tuning. Every one of the tone degrees within the chosen range will be represented by at least one string 52, if a single chord (string) structure is used. The lower octave range will be provided in this instrument through the fact that the oscillations of the strings 52 will be converted into electric oscillations and then will be lowered at the rate of one octave by means of an electronic circuit for the division of frequency. Such electronic circuits are well known in the art.

As already mentioned, the strings will be stimulated for oscillation and damped by mechanism similar to that of a piano. However, this mechanism will not be driven directly through keys, but through electromagnetic driving means, preferably electromagnets for linear lifting. FIG. 10 includes a simplified schematic representation of such driving means. Above the lifting member 67 the mechanism may be constructed like the conventional piano mechanism, including the usual common parts like dampers and repetition members, not here shown.

Below the lifting member 67, the mechanism is arranged for electromagnetic driving. Each string 52 has its own electromagnet 68, which is pivoted for tilting, and an armature 69 which carries a roller 70. If the electromagnet is not energized, the armature is withdrawn and the roller 70 does not lie over the lift bar 71. But when the electromagnet is energized, the armature is projected to place the roller directly over the lift bar 71. Another electromagnet 72 serves for the execution of a dynamic attack of tone. When it is energized, its armature 73 moves upwardly and raises the lift bar 71. If the roller 70 happens to be above the lift bar at this time, the upward motion of the lift bar will raise the roller and this will raise the member 67 to actuate the hammer mechanism 53, thus producing the desired action on the string. By applying various voltages to the electromagnet 72, its armature 73 can be moved with various velocities or impulses. This makes possible a control of a variable dynamic attack.

The division of the electromagnets into two groups, one for the selection of the various strings 52 and the other for the execution of a dynamic attack, has the advantage that it is not necessary to provide a separate dynamically working electromagnet for each separate tone degree. The same lift bar 71 may extend past and serve to operate all or several of the individual rollers 70 of the individual strings.

Figure 12:
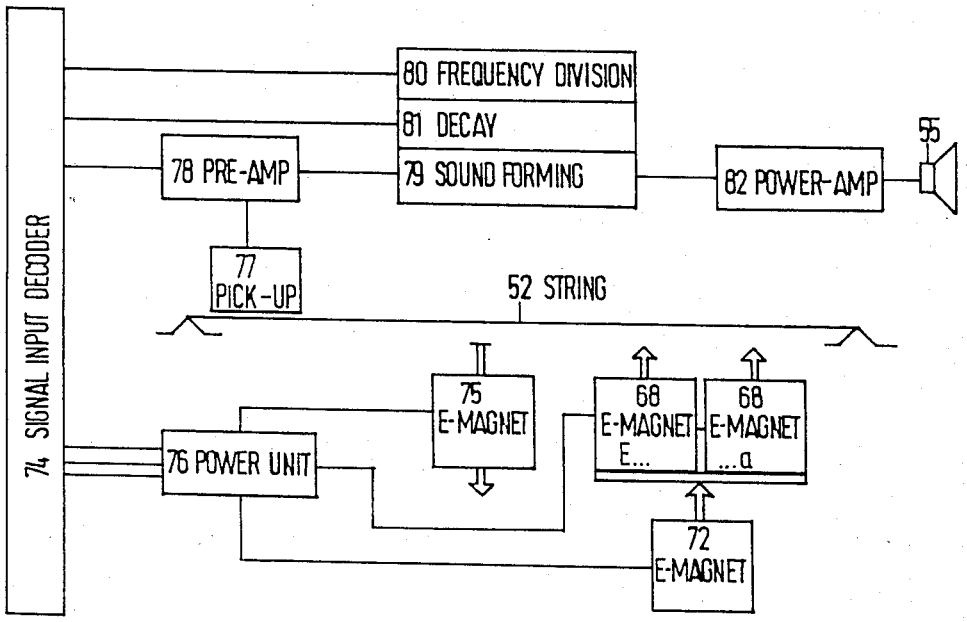
FIG. 12 is a block diagram of certain features of the sound generating means.

Referring now to FIG. 12, this is a block diagram to illustrate the relationships and results of certain electronic circuits and other parts in the sound generating device or portion of the instrument. Control signals arriving from the control device are decoded in a signal input decoder 74, and are conducted thence to the various parts of the equipment with the help of their digital addresses. The control signals for the electromagnets 68, 72, and 75 are conducted from the decoder to a power unit 76, which produces the necessary power for the electromagnets. The electromagnet 75 serves to lift all dampers of the mechanism for string stimulation and damping.

The pick-ups 77 convert the mechanical vibrations of the strings 52 into electrical oscillations, which are amplified in the pre-amp unit 78. To emphasize the effect of a dynamic attack, the pre-amp unit 78 and the sound-forming unit 79 are controlled by the same control signals, so that the amplitude of the tone will be boosted additionally and the formants of the tone will be transposed into a higher frequency range, if the player plays a hard attack.

The unit 80 for frequency division and the unit 81 for tone decay can be directly switched on or off. The tone signals reach the speaker 55 via the power-amplifier unit 82.

It is possible to utilize the control device of the invention to control equipment for sound generation which produces noises instead of musical tones.

It should be understood that the above described embodiments are only examples illustrating the principles of the invention. Many variations are possible within the skill of the art, once these principles are understood.

Details of the various electric or electronic circuits are not disclosed here, because it is believed that the design of such circuits is within the skill of workers in the electronic musical instrument field, when they have learned from the present invention disclosure, what effect is desired to be produced by a particular movement of a particular member or control element. See the remarks of similar import in my U.S. Pat. No. 4,123,960, granted Nov. 7, 1978, column 1, lines 9–34, which remarks apply in general to the present invention.

What is claimed is:

1. A foot-controlled musical instrument including means for emitting sounds, a control unit comprising a support structure (1), a heel rest (2,3, 84) on which the heel portion of a player's foot or shoe may rest while the instrument is being played, said heel rest being mounted for movement in at least one approximately horizontal direction relative to said support structure, a plurality of pedal keys (4, 83) arranged in an arc of a circle approximately concentric with said heel rest and positioned so that when said heel portion is on said heel rest, the foot may be rotated to enable the anterior portion of the foot to engage and activate any selected one of said pedal keys, and a mounting plate (19) on which said pedal keys are mounted, said mounting plate being arranged for upward and downward movement relative to said support structure, activation of said pedal keys serving to determine in part what sounds are emitted, first means responsive to movement of said heel rest in one approximately horizontal direction serving to vary one characteristic of the emitted sounds, and second means responsive to movement of said mounting plate serving to vary another characteristic of the emitted sounds.

2. The invention defined in claim 1, wherein said heel rest is of approximately circular shape.

3. The invention defined in claim 2, wherein said heel rest is mounted for free rotation relative to said support structure, to facilitate angular turning of the anterior portion of a foot in order to touch a desired pedal key while said heel portion is firmly engaged with said heel rest.

4. The invention defined in claim 1, further comprising means responsive to changes in downward pressure exerted on said heel rest by a player for varying a characteristic of the emitted sounds.

5. The invention defined in claim 4, wherein said means responsive to changes in downward pressure includes a pressure-sensitive converter (84).

6. The invention defined in claim 4, wherein said means responsive to changes in downward pressure includes mounting means mounting said heel rest for upward and downward movement, and a plurality of converters (45, 46) each responsive to a particular position of said heel rest within its range of upward and downward movement.

7. The invention defined in claim 1, wherein said heel rest is mounted for approximately horizontal movement in directions along two axes at approximately a right angle relative to each other, said first means responsive to movement along one axis serving to vary one characteristic and a third means responsive to movement along the other axis serving to vary a different characteristic of the emitted sounds.

8. The invention defined in claim 1, further comprising spring means tending to hold said mounting plate at an upper limit of a range of travel, said plate being depressible below said upper limit by downward pressure applied to said pedal keys by the anterior portion of the player's foot.

9. The invention defined in claim 8, said second means further comprising light projecting means (31), a photoresponsive converter (32) positioned to receive light from said projecting means, said converter having an output which varies a characteristic of the emitted sounds, and a diaphragm controlling the amount of light which reaches said converter from said projecting means, said diaphragm being operatively connected to said mounting plate and arranged to vary the amount of light in accordance with the extent to which said mounting plate is depressed.

10. A foot-controlled musical instrument including means for emitting sounds, a control unit having a heel rest on which a player's heel may be placed while playing the instrument, said heel rest being mounted for upward and downward movement in response to varying downward pressure exerted by the player's heel, means responsive to the upward and downward movement of said heel rest for varying a characteristic of the sounds emitted by said instrument, a series of control members arranged in an arc relative to said heel rest and positioned so that a forward part of a foot of a player may press upon any selected one of said control members while the heel of the foot remains on said heel rest and swings from side to side to position said forward part over the selected member, and means responsive to pressure on said control members for controlling sounds emitted by said instrument, said control members being knob-like members (4) and being mounted for adjustment along approximately radial lines toward and away from said heel rest, to accommodate the distance from the heel rest to the control members to feet of different sizes.

11. A foot-controlled musical instrument including means for emitting sounds, a control unit having a heel rest on which a player's heel may be placed while playing the instrument, said heel rest being mounted for upward and downward movement in response to varying downward pressure exerted by the player's heel, means responsive to the upward and downward movement of said heel rest for varying a characteristic of the sounds emitted by said instrument, a series of control members arranged in an arc relative to said heel rest and positioned so that a forward part of a foot of a player may press upon any selected one of said control members while the heel of the foot remains on said heel rest and swings from side to side to position said forward part over the selected member, means responsive to pressure on said control members for controlling sounds emitted by said instrument, said heel rest being mounted for limited movement approximately horizontally in addition to its upward and downward movement, and means responsive to approximately horizontal movement of said heel rest for controlling sounds emitted by said instrument, said means responsive to movements of said heel rest and to pressure on said control members including electronic means.

* * * * *